US010704282B2

(12) United States Patent
Dufilho et al.

(10) Patent No.: US 10,704,282 B2
(45) Date of Patent: Jul. 7, 2020

(54) POOL CLEANER

(71) Applicants: Michael Todd Dufilho, Baton Rouge, LA (US); Cory John Zimmerman, Prairieville, LA (US)

(72) Inventors: Michael Todd Dufilho, Baton Rouge, LA (US); Cory John Zimmerman, Prairieville, LA (US)

(73) Assignee: RP 2020, LLC, Baton Rouge, LA (US)

( * ) Notice: Subject to any disclaimer, the term of this patent is extended or adjusted under 35 U.S.C. 154(b) by 0 days.

(21) Appl. No.: 16/125,456

(22) Filed: Sep. 7, 2018

(65) Prior Publication Data

US 2020/0080331 A1 Mar. 12, 2020

(51) Int. Cl.
*E04H 4/16* (2006.01)

(52) U.S. Cl.
CPC ..... *E04H 4/1636* (2013.01)

(58) Field of Classification Search
CPC ..... E04H 4/1636
USPC ..... 210/167.16, 167.17, 238, 416.1, 416.2; 15/1.7
See application file for complete search history.

(56) References Cited

U.S. PATENT DOCUMENTS 4,052,950 A * 10/1977 Hirata ..... B63B 59/10 114/222
5,768,734 A * 6/1998 Dietrich ..... E04H 4/1618 15/1.7
6,939,460 B2 9/2005 Erlich
8,956,533 B2 * 2/2015 Gopalan ..... E04H 4/1663 210/167.16
2005/0108836 A1 * 5/2005 Rowan ..... E04H 4/1636 15/1.7
2007/0107148 A1 * 5/2007 Rowan ..... E04H 4/1636 15/1.7
2016/0032604 A1 * 2/2016 Chen ..... E04H 4/1636 210/167.16
2018/0328059 A1 * 11/2018 Hayes ..... E04H 4/1618

OTHER PUBLICATIONS

Poolmaster 28316 Leaf Vacuum—Premier collection https://www.amazon.com/dp/B0020H42VY/ref=psdc_1272982011_t2_ . . . , Jun. 6, 2018.
GSV Store Water Tech Pool Blaster Battery Powered Floseless Leaf Vac Vacuum Cleaner LVAC100, https://www.amazon.com/GSV-Store-Blaster-Battery-Hoseless/dp/B07 . . . , Jun. 6, 2018.

* cited by examiner

*Primary Examiner* — Fred Prince
(74) *Attorney, Agent, or Firm* — John B. Edel; Edel Patents LLC

(57) ABSTRACT

Pool cleaners are disclosed relating to underwater vacuum cleaning that include a main body, a debris discharge opening, a debris suction opening and a pressure chamber. The pressure chamber may be arranged around an unobstructed cylindrical flow path with the pressure chamber being positioned between the debris discharge opening and the debris suction opening such that water discharged from the pressure chamber directs debris into a debris bag. The cleaners may further be configured to operate by way of a submersible pump, submersible electric motor and a battery.

19 Claims, 4 Drawing Sheets

POOL CLEANER

Cleaners described herein may be used in the cleaning of swimming pools and other water features that have similar needs for dirt and debris removal. Certain pool cleaners disclosed herein may engage in battery powered suction cleaning with a large clear path through the center of the cleaner fir removal of debris from the pool.

DETAILED DESCRIPTION

Figure 1:
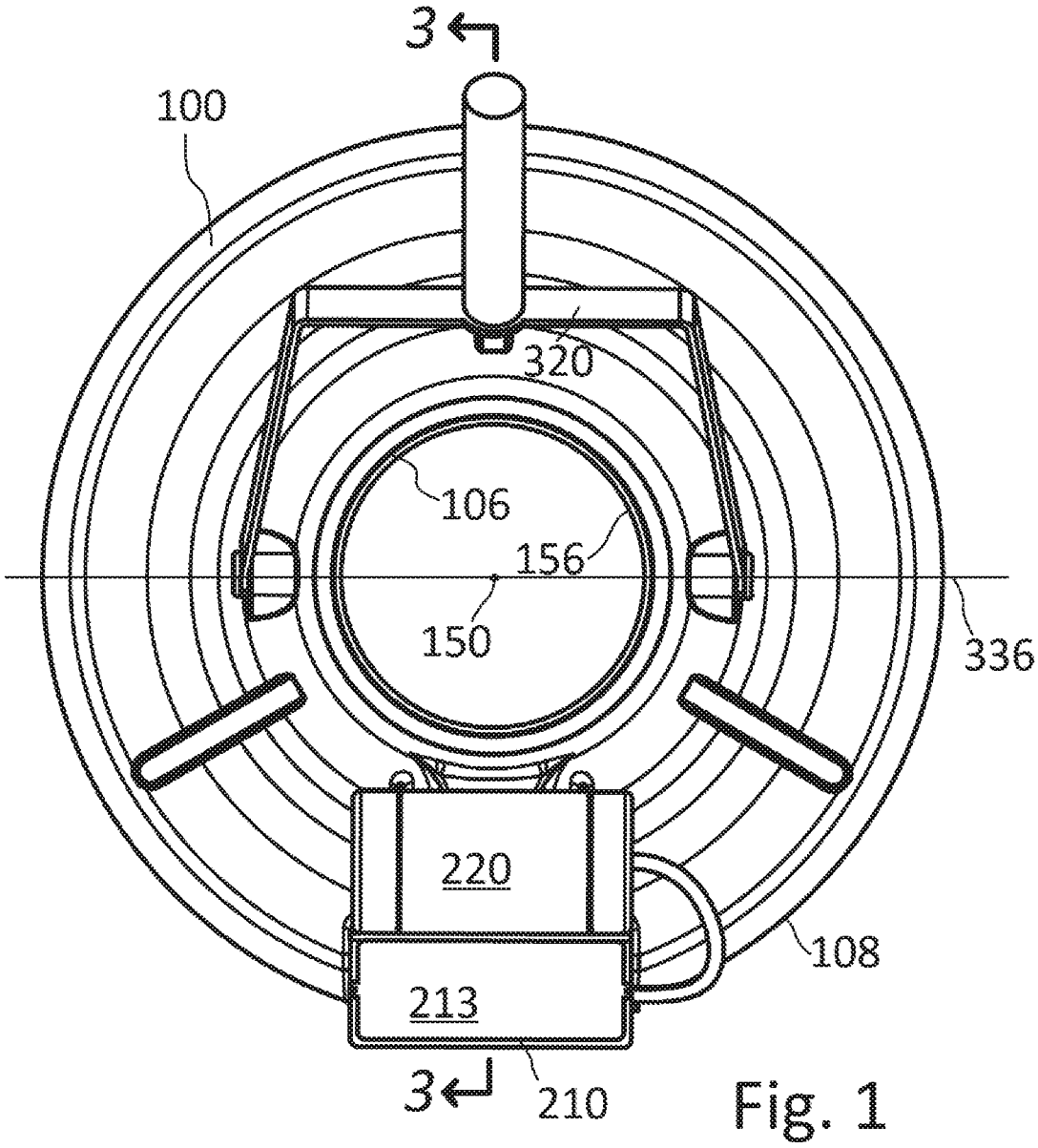
FIG. 1 shows a plan view of a pool cleaner.

FIGS. 1-4 depict various views of an embodiment of a pool cleaner. Depicted in FIGS. 1-4 are Cleaner 100, Main body 103, Upper rim 106, Main body lower rim 108, Main body flow channel recess 110, Main body exhaust stack 120, Debris discharge opening 130, Debris suction opening 140, Central axis 150, Cylindrical flow path 156, Debris bag 160, Debris bag buoyant body 166, Battery compartment 210, Battery compartment lid 213, Battery compartment gasket 215, Battery 216, On-off switch 217, Pump and motor unit 220, Impeller 231, Pump intake 238, Pressure chamber 240, Pressure chamber insert 246, Pressure chamber side 247, Channels 250, Apertures 256, Pole 310, Pole attachment fork 320, Pole attachment pin 330, Pole attachment hole 333, Pivot axis 336, Caster wheels 340 and Resting surface 346.

Cleaner 100 is a pool vacuum cleaner and the area under Main body 103 along with the area adjacent to Main body lower rim 108 are the primary areas that are subject to the suction of Cleaner 100. Upper rim 106 is the upper extent of Main body 103 and materials discharged past Upper rim 106 flow into a debris bag. Main body 103 may be situated around. Central axis 150 and certain elements of Main body 103, such as Main body lower rim 108, may be symmetrical or approximately symmetrical about Central axis 150. In many embodiments, a Cylindrical flow path 156 that surrounds Central axis 150 creates a significant unobstructed space through which water may freely flow. Not wishing to be bound by theory, Cleaner 100 may operate according to principles associated with venturi pumps. Pump and motor unit 220 provides the flow necessary to create a vacuum that allows Cleaner 100 to operate. All the liquid within Main body 103 may be water and all the liquid within Pressure chamber 240 may be water. Further, Cleaner 100 may operate without the aid of any flexible hose, such as a garden hose. In particular, Cleaner 100 may operate without any source of water from outside the pool being cleaned.

Figure 2:
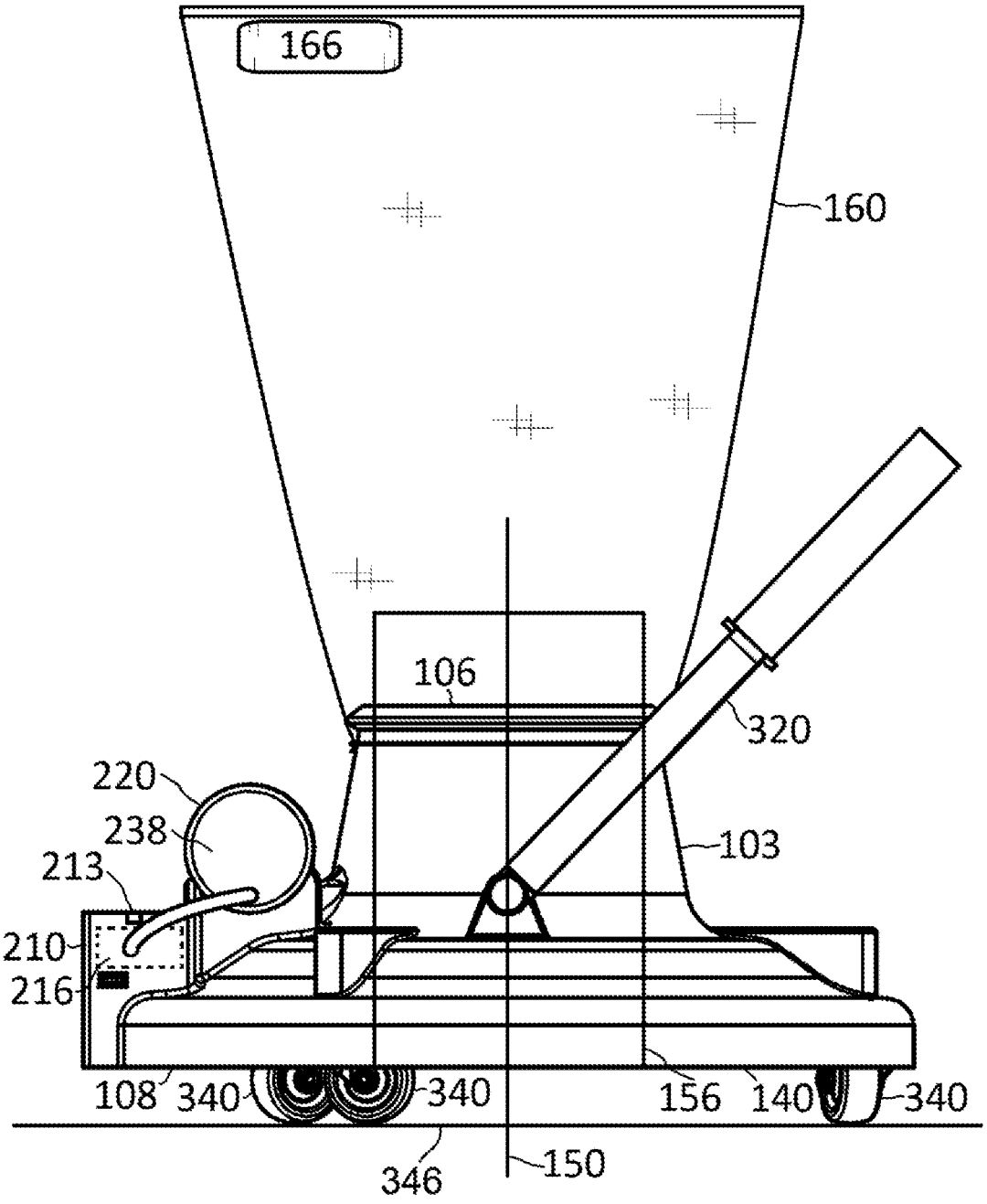
FIG. 2 shows a side elevation view of a pool cleaner.
Figure 3:
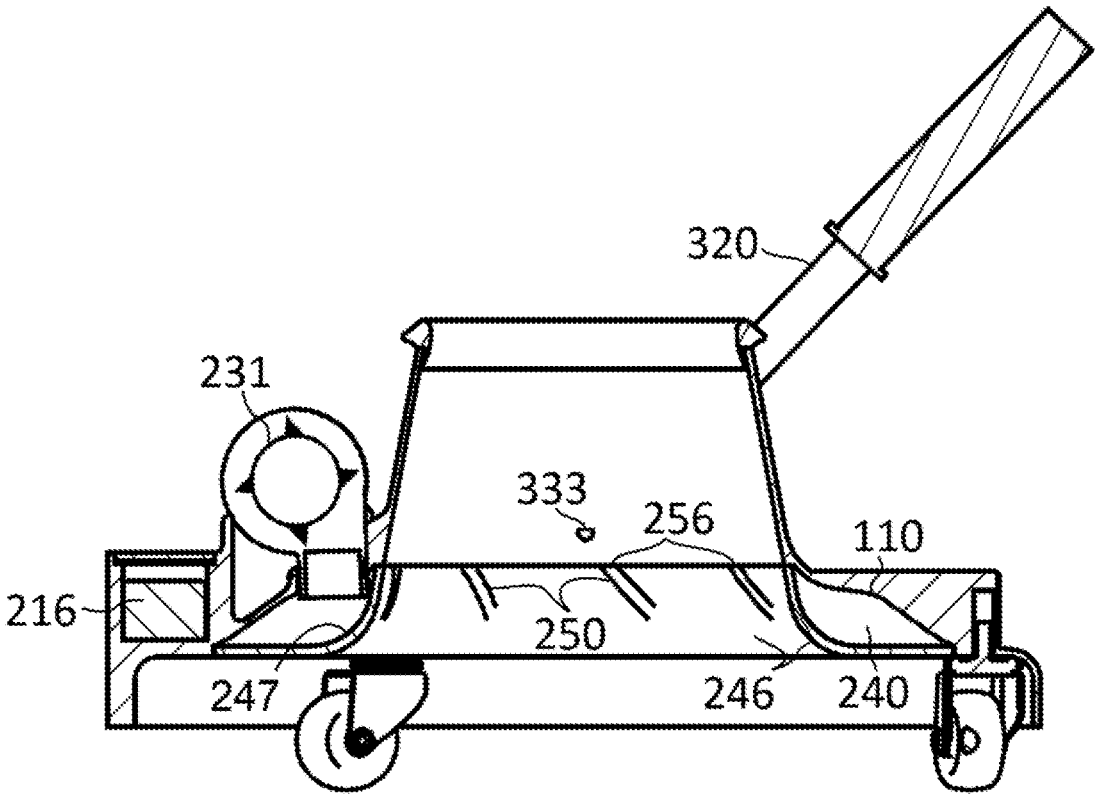
FIG. 3 shows a side elevation cross sectional view of a pool cleaner.
Figure 4:
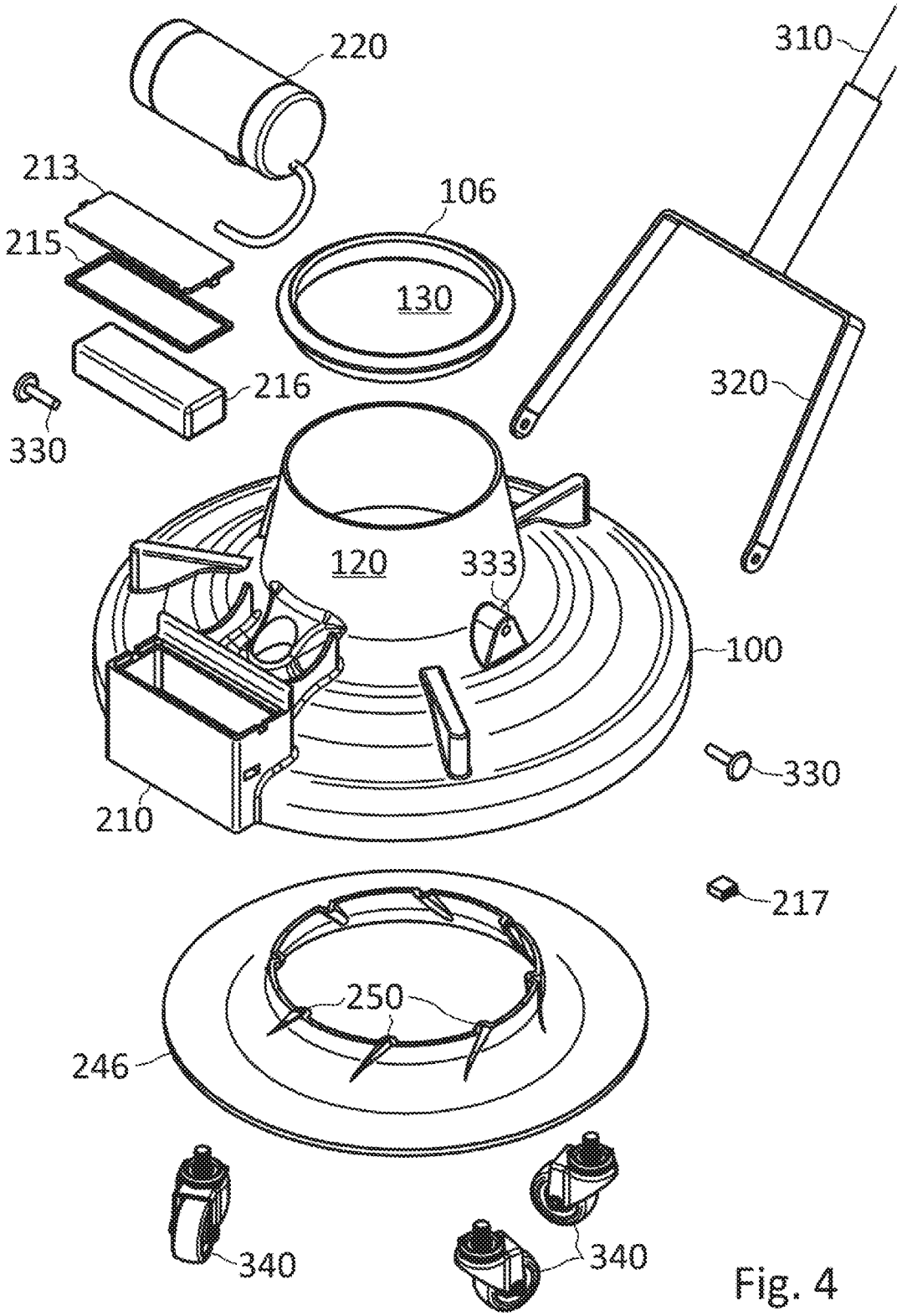
FIG. 4 shows an exploded perspective view of a pool cleaner.

FIGS. 2 and 3 depict an elevation view and a cross section elevation view of Cleaner 100 respectively. Main body 103 may be a single piece plastic injection molded component generally having an outside diameter of 16.5 inches and a height of 8 inches measured between the top of Upper rim 106 and the Main body lower rim 108. When the pool is being cleaned, debris is sucked through the space between Main body lower rim 108 and the pool surface being cleaned. The debris being removed then enters the space inside of Main body 103 through Debris suction opening 140 which is the opening formed by Main body lower rim 108. The debris being removed is entrained in the water which ultimately moves through Debris suction opening 140, passes through Main body 103, and is discharged through Debris discharge opening 130 at Upper rim 106. Main body exhaust stack 120 is a portion of Main body 103 and is the portion of Main body 103 in which the water and debris are directed toward and ultimately through Main body exhaust stack 120. Upper rim 106 may take the form of a separate plastic piece or may be a single contiguous plastic component part of Main body 103. Main body flow channel recess 110 is the portion of Main body 103 that accepts Pressure chamber insert 246 to form Pressure chamber 240. Pressure chamber insert 246 may be fitted within Main body 103 by friction fit, clip, plastic welding or other similar means. As water exits Main body exhaust stack 120 that water may rotate about Central axis 150. Further, the flow of water through Main body 103 may be enhanced by a Cylindrical flow path 156 of significant size centered around Central axis 150.

Central axis 150 is defined as the vertical line passing through the centroid of Debris discharge opening 130 at Upper rim 106 when Main body 103 is resting on a horizontal resting surface as that resting surface is later described with greater particularity. Cylindrical flow path 156 is defined as the cylinder that is centered around Central axis 150 and extends vertically from Debris suction opening 140 to a point four inches beyond Debris discharge opening 130. Cylindrical flow path 156 may be completely absent of components of Main body 103 inside the cylinder, providing the unobstructed flow path for the water. The cylinder diameter of Cylindrical flow path 156 may, for example, be 5.0 in with certain examples falling between 2.5 and 9.0 in and a significant number of those examples falling between 3.8 and 7.0 in.

Debris bag 160 catches the debris exhausted from Main body 103 and Debris bag buoyant body 166 may help Debris bag 160 stay upright during operation further enhancing the removal of debris from pool surfaces. Battery compartment 210 may be a fully sealed watertight compartment enclosed at the top by Battery compartment lid 213. Battery 216 may be a lithium polymer battery and may be located within Battery compartment 210. On-off switch 217 controls an electrical circuit that powers Pump and motor unit 220 thereby controlling the operation of Cleaner 100. Pump and motor unit 220 may be located on the exterior of Main body 103 and may be immediately adjacent to Pressure chamber 240. In particular, Impeller 231 may be immediately adjacent to Pressure chamber 240. In certain examples, the distance between Impeller 231 and Pressure chamber 240 is less than five inches. In certain examples, the distance between Impeller 231 and Pressure chamber 240 is less than three inches. Pump intake 238 of Pump and motor unit 220 may also be positioned such that a pump intake horizontal separation distance, which is the horizontal separation between Central axis 150 and the portion of Pump intake 238 that is closest to Central axis 150, is relatively small. The pump intake horizontal separation distance may, for example, be 4.0 in. with certain examples falling between 2.0 and 9.0 in. and a significant number of those examples falling between 3.0 and 6.5 in. Pump intake 238 of Pump and motor unit 220 may also be positioned such that a pump intake vertical separation distance, which is the vertical separation between Resting surface 346 and the portion of Pump intake 238 that is closest to Resting surface 346, is sufficient to avoid attracting significant debris. The pump intake vertical separation distance may, for example, be 4.0 in. with certain examples falling between 2.0 and 9.0 in. and a significant number of those examples falling between 3.0 and 6.5 in.

Pole attachment fork 320 may be configured to attach to a Pole attachment pin 330 located on the side of Main body 103. Pole attachment fork 320 may be attached to Main body 103 by inserting Pole attachment pin 330 through Pole attachment fork 320 and into Pole attachment hole 333, affixing it within Pole attachment hole 333. A variety of other methods may be used for similar pivoting attachments including involving those involving a clevis pin type configuration. Pole attachment fork 320 may also attach to Main body 103 by other means that allow Main body 103 to freely rotate within Pole attachment fork 320. Other single point or single location pole attachments may also be used with the embodiments disclosed herein. Pole attachment fork 320 may then attach to Pole 310 which may be any type of pole suitable for positioning Cleaner 100 in the various places that need to be cleaned.

The line connecting the Pole attachment pin 330 on one side of Main body 103 to the Pole attachment pin 330 on the other side is the pivot axis because it is the axis around which Pole attachment fork 320 and Main body 103 rotate with respect to one another during the operation of the Cleaner 100. Pivot axis 336 may, for example, be separated from Central axis 150 by fewer than three inches. Pivot axis 336 may, for example, be separated from Central axis 150 by fewer than two inches. Pivot axis 336 may, for example, be separated from Central axis 150 by less than one inch. Further, the pivot height is the height from the surface of Pivot axis 336. The pivot height may, for example, be 4.0 in. with certain examples falling between 1.0 and 9.0 in. and a significant number of those examples falling between 2.5 and 6.5 in.

Pressure chamber insert 246 may have Channels 250 formed into the Pressure chamber side 247 of Pressure chamber insert 246 such that water exiting Apertures 256 flows toward the main body exhaust stack while rotating about Central axis 150.

Flow characteristics of Cleaner 100, including particular characteristics of Pump and motor unit 220, Pressure chamber 240, and Apertures 256 may be characterized by a variety of parameters including aperture flow output, chamber operating pressure and pump operation wattage. Pump operation wattage is the total wattage drawn by the pump and motor during normal operation. Pump operation wattage may, for example, be 700 watts with certain examples falling between 300 and 1500 watts and a significant number of those examples falling between 500 and 1100 watts. Aperture flow output is the total flow rate of water discharged from the apertures measured in gallons per minute. In cleaners having lower chamber operating pressures the aperture flow output may, for example, be 110 GPM with certain examples falling between 50 and 150 GPM and a significant number of those examples falling between 80 and 130 GPM. In cleaners having higher chamber operating pressures the aperture flow output may, for example, be 8 GPM with certain examples falling between 3 and 50 GPM and a significant number of those examples falling between 6 and 29 GPM. Chamber operating pressures represent the normal operating differential pressure of the pressure chamber feeding the apertures measured in pounds per square inch as compared to the water pressure immediately outside of the cleaner as measured at a point that is not adjacent to any cleaner suction or discharge. In cleaners having lower chamber operating pressures the chamber operating pressures may, for example, be 20 psi with certain examples falling between 5 and 40 psi and a significant number of those examples falling between 13 and 30 psi. In cleaners having higher chamber operating pressures, the chamber operating pressures may, for example, be 90 psi with certain examples falling between 40 and 130 psi and a significant number of those examples falling between 65 and 110 psi.

Battery 216 has a battery storage capacity that is measured in amp hours. battery storage capacity may, for example, be 2.0 Ah with certain examples falling between 0.5 and 8.0 Ah and a significant number of those examples falling between 1.2 and 3.4 Ah.

The location of certain features may be described with reference to a "resting surface." In such cases the resting surface is understood to be a horizontal plane on which Cleaner 100 would rest with all Caster wheels 340 touching the resting surface and the entirety of Cleaner 100 being above the resting surface. The resting surface serves as a frame of reference for the height of various components relative to that surface, referred to herein as the "height from the surface." Despite this convention for characterizing Cleaner 100, it is understood that Cleaner 100 is arranged and configured to clean a wide variety of surfaces including varying surface contours and surface orientations. In certain examples, Pump and motor unit 220 has a pump and motor center of gravity that has a height from the surface of less than 10 inches. In certain examples, Pump and motor unit 220 has a pump and motor center of gravity that has a height from the surface of less than 7 inches. In certain examples, the shortest distance between Pump intake 238 and Main body lower rim 108 of Debris suction opening 140 is greater than three inches. Motor center of gravity height is the height from the surface of the center of gravity the motor above a resting surface. Motor center of gravity height may, for example, be 4.0 inches with certain examples falling between 2.0 and 7.0 inches and a significant number of those examples falling between 3.0 and 5.0 inches.

As that term is used herein "aperture rotation angle" is the angle from which the flow direction from Apertures 256 departs from a vertical radial plane passing through Central axis 150. Accordingly, a set of apertures having an aperture rotation angle of 0° would not create any substantial rotation about Central axis 150 whereas an aperture rotation angle of 30° would create a substantial rotation about Central axis 150. For further clarification, the portion of an aperture angle that departs from vertical purely in the direction of the central axis is not part of the aperture rotation angle. The aperture rotation angle may, for example, be 30.0° with certain examples falling between 5.0 and 60.0° and a significant number of those examples falling between 17.5 and 45.0°.

In an alternate embodiment, Pump and motor unit 220 and Battery 216 may be located either on Pole attachment fork 320 or on the pole such that the pump provides pressure and flow to Pressure chamber 240 in a manner comparable to the other described embodiments. Such arrangement may be accomplished by hose, tubing or other suitable flexible conduit.

References to Pump and motor unit 220 are exemplary such that pumps and motors may be included as separate components.

Pool cleaners described herein may, for example, comprise a main body arranged around an unobstructed cylindrical flow path having a central axis; wherein the main body comprises a debris discharge opening encompassing a first portion of the unobstructed cylindrical flow path; wherein the main body comprises a debris suction opening that encompasses a second portion of the unobstructed cylindrical flow path; a pressure chamber arranged around the unobstructed cylindrical flow path, the pressure chamber being positioned between the debris discharge opening and the debris suction opening; a series of apertures arranged around the pressure chamber; a submersible pump in fluid communication with the pressure chamber; a submersible electric motor arranged and configured to drive the submersible pump; a battery that is electrically connected to the submersible electric motor; a debris bag extending away from the main body from the debris discharge opening; a forked pole connector attached to the body at a first connection point and a second connection point such that the forked pole connector may pivot about the main body around a pivot axis; such that the pivot axis is located within two inches of the central axis; such that the unobstructed cylindrical flow path has a diameter of at least three inches and such that the series of apertures is arranged and configured to direct water through the debris discharge opening such that a fluid exiting the debris discharge opening rotates about the central axis while exiting the main body. In a related example, the unobstructed cylindrical flow path may have a diameter of at least 4 inches. In a related example, the pool cleaner may also have at least three wheels. In a related example, all of the water within the main body may be pool water. In a related example, the pivot axis may be arranged and configured to be within four inches of a pool floor during a cleaning operation. In a related example, the series of apertures may have at least four individual apertures. In a related example, the series of apertures may have a number of apertures selected from four, five, six, seven, eight and nine. In a related example, the submersible pump may consume between 300 and 1500 watts during normal operation. In a related example, the battery may be a lithium polymer battery. In a related example, the battery may have a storage capacity between 0.5 and 8.0 Ah. In a related example, the submersible pump may be arranged opposite the forked pole connector on the main body. In a related example, the pool cleaner may have a set of castor wheels. In a related example, the series of apertures may be formed by a series of channels located in a ring-shaped insert fitted against the main body.

Pool cleaners described herein may, for example, comprise a main body arranged around an unobstructed cylindrical flow path having a central axis; wherein the main body comprises a debris discharge opening encompassing a first portion of the unobstructed cylindrical flow path; wherein the main body comprises a debris suction opening that encompasses a second portion of the unobstructed cylindrical flow path; a pressure chamber arranged around the unobstructed cylindrical flow path, the pressure chamber being positioned between the debris discharge opening and the debris suction opening; a series of apertures arranged around the pressure chamber; a submersible pump in fluid communication with the pressure chamber; a submersible electric motor arranged and configured to drive the submersible pump; a battery that is electrically connected to the submersible electric motor; a debris bag extending away from the main body from the debris discharge opening and a buoyant body supporting the debris bag; such that the unobstructed cylindrical flow path may have a diameter of at least three inches and such that the series of apertures may be arranged and configured to direct water through the debris discharge opening such that a fluid exiting the debris discharge opening rotates about the central axis while exiting the main body. In a related example, the unobstructed cylindrical flow path has a diameter of at least 4 inches. In a related example, the pivot axis may be arranged and configured to be within four inches of a pool floor during a cleaning operation. In a related example, the series of apertures may have at least four individual apertures. In a related example, the submersible pump may consume between 300 and 1500 watts during normal operation. In a related example, the battery may have a storage capacity between 0.5 and 8.0 Ah. In a related example, the series of apertures are formed by a series of channels located in a ring-shaped insert fitted against the main body.

The above-described embodiments have a number of independently useful individual features that have particular utility when used in combination with one another including combinations of features from embodiments described separately. There are, of course, other alternate embodiments which are obvious from the foregoing descriptions, which are intended to be included within the scope of the present application.

We claim:

1. A pool cleaner comprising:

a. a main body arranged around an unobstructed cylindrical flow path having a central axis;

b. wherein the main body comprises a debris discharge opening encompassing a first portion of the unobstructed cylindrical flow path;

c. wherein the main body comprises a debris suction opening that encompasses a second portion of the unobstructed cylindrical flow path;

d. a pressure chamber arranged around the unobstructed cylindrical flow path, the pressure chamber being positioned between the debris discharge opening and the debris suction opening;

e. a series of apertures arranged around the pressure chamber;

f. a submersible pump in fluid communication with the pressure chamber;

g. a submersible electric motor arranged and configured to drive the submersible pump;

h. a battery that is electrically connected to the submersible electric motor;

i. a debris bag extending away from the main body from the debris discharge opening;

j. a forked pole connector attached to the main body at a first connection point and a second connection point such that the forked pole connector may pivot about the main body around a pivot axis;

k. wherein the pivot axis is located within two inches of the central axis;

l. wherein the unobstructed cylindrical flow path has a diameter of at least three inches and m. wherein the series of apertures is arranged and configured to direct water through the debris discharge opening such that a fluid exiting the debris discharge opening rotates about the central axis while exiting the main body.

2. The pool cleaner of claim 1 wherein the unobstructed cylindrical flow path has a diameter of at least 4 inches.

3. The pool cleaner of claim 1 further comprising at least three wheels.

4. The pool cleaner of claim 1 wherein all water within the main body is pool water.

5. The pool cleaner of claim 1 wherein the series of apertures comprises at least four individual apertures.

6. The pool cleaner of claim 1 wherein the series of apertures comprises a number of apertures selected from four, five, six, seven, eight and nine.

7. The pool cleaner of claim 1 wherein the submersible pump consumes between 300 and 1500 watts during normal operation.

8. The pool cleaner of claim 1 wherein the battery is a lithium polymer battery.

9. The pool cleaner of claim 1 wherein the battery has a storage capacity between 0.5 and 8.0 Ah.

10. The pool cleaner of claim 1 wherein the submersible pump is arranged opposite the forked pole connector on the main body.

11. The pool cleaner of claim 1 further comprising a set of castor wheels.

12. The pool cleaner of claim 1 wherein the series of apertures are formed by a series of channels located in a ring-shaped insert fitted against the main body.

13. A pool cleaner comprising:

a. a main body arranged around an unobstructed cylindrical flow path having a central axis;

b. wherein the main body comprises a debris discharge opening encompassing a first portion of the unobstructed cylindrical flow path;

c. wherein the main body comprises a debris suction opening that encompasses a second portion of the unobstructed cylindrical flow path;

d. a pressure chamber arranged around the unobstructed cylindrical flow path, the pressure chamber being positioned between the debris discharge opening and the debris suction opening;

e. a series of apertures arranged around the pressure chamber;

f. a submersible pump in fluid communication with the pressure chamber;

g. a submersible electric motor arranged and configured to drive the submersible pump;

h. a battery that is electrically connected to the submersible electric motor;

i. a debris bag extending away from the main body from the debris discharge opening and j. a buoyant body supporting the debris bag;

k. wherein the unobstructed cylindrical flow path has a diameter of at least three inches and l. wherein the series of apertures is arranged and configured to direct water through the debris discharge opening such that a fluid exiting the debris discharge opening rotates about the central axis while exiting the main body.

14. The pool cleaner of claim 13 wherein the unobstructed cylindrical flow path has a diameter of at least 4 inches.

15. The pool cleaner of claim 13 further comprising a pole connector attached to the main body such that the pole connector may pivot about the main body around a pivot axis wherein the pivot axis is arranged and configured to be within four inches of a pool floor during a cleaning operation.

16. The pool cleaner of claim 13 wherein the series of apertures comprises at least four individual apertures.

17. The pool cleaner of claim 13 wherein the submersible pump consumes between 300 and 1500 watts during normal operation.

18. The pool cleaner of claim 13 wherein the series of apertures are formed by a series of channels located in a ring-shaped insert fitted against the main body.

19. A pool cleaner comprising:

a. a main body arranged around an unobstructed cylindrical flow path having a central axis;

b. wherein the main body comprises a debris discharge opening encompassing a first portion of the unobstructed cylindrical flow path;

c. wherein the main body comprises a debris suction opening that encompasses a second portion of the unobstructed cylindrical flow path;

d. a pressure chamber arranged around the unobstructed cylindrical flow path, the pressure chamber being positioned between the debris discharge opening and the debris suction opening;

e. a series of apertures arranged around the pressure chamber;

f. a submersible pump in fluid communication with the pressure chamber;

g. a submersible electric motor arranged and configured to drive the submersible pump;

h. a battery that is electrically connected to the submersible electric motor;

i. a debris bag extending away from the main body from the debris discharge opening;

j. a forked pole connector attached to the main body at a first connection point and a second connection point such that the forked pole connector may pivot about the main body around a pivot axis;

k. wherein the pivot axis is located within two inches of the central axis;

l. wherein the unobstructed cylindrical flow path has a diameter of at least three inches and m. a buoyant body supporting the debris bag.

* * * * *